United States Patent [19]

Sasaki et al.

[11] Patent Number: 4,901,780

[45] Date of Patent: Feb. 20, 1990

[54] METHOD FOR PRODUCING FIBER REINFORCED METAL COMPOSITION

[75] Inventors: Masayoshi Sasaki, Ayase; Fumio Saeki, Atsugi; Harumichi Hino, Yokohama, all of Japan

[73] Assignees: Nissan Motor Company, Limited, Yokohama; Atsugi Motor Parts Company, Atsugi, both of Japan

[21] Appl. No.: 225,208

[22] Filed: Jul. 28, 1988

[30] Foreign Application Priority Data

Jul. 28, 1987 [JP] Japan ..... 62-189670

[51] Int. Cl.[4] ..... B22D 19/14

[52] U.S. Cl. ..... 164/4.1; 164/97; 164/120; 164/151; 164/154

[58] Field of Search ..... 164/4.1, 151, 154, 97, 164/108, 109, 110, 120

[56] References Cited

FOREIGN PATENT DOCUMENTS 3021978 2/1981 Fed. Rep. of Germany ..... 164/151

*Primary Examiner*—Kuang Y. Lin

*Attorney, Agent, or Firm*—Foley & Lardner, Schwartz, Jeffery, Schwaab, Mack, Blumenthal & Evans

[57] ABSTRACT

A method of producing a fiber reinforced metal composition is characterized by a unique and successful pressure exerting program for consolidating a fiber assembly fabricated into a desired configuration and a molten metal matrix. The program is generally constituted a first step in which relatively low pressure is exerted on the molten metal for consolidation of the fiber assembly and the molten metal and a second step in which pressure is instantly increased to a maximum pressure for solidification of the metal matrix.

20 Claims, 3 Drawing Sheets

METHOD FOR PRODUCING FIBER REINFORCED METAL COMPOSITION

BACKGROUND OF THE INVENTION

1. Field of the Invention

The present invention relates generally to a fiber reinforced metal composition. More specifically, the invention relates to a method for producing a fiber reinforced metal composition utilizing a fabricated fiber assembly. Further particularly, the invention relates to a method for producing a fiber reinforced metal composition, which method can be implemented without limitation by kind of fabricated fiber assembly and/or metal matrix, volume density of the fiber assembly.

2. Description of the Background Art

Japanese Patent Second (examined) Publication (Tokko) Showa 54-36138 discloses a method for producing a fiber reinforced metal composition, in which fiber of inorganic material is fabricated into a sheet. A molten metal matrix is consolidated with the fiber sheet to form a sheet form fiber reinforced metal composition. For implementing consolidation of the molten metal with the fiber sheet, pressure is exerted on the molten metal, which pressure is adjusted according to an encapsuling program. In the encapsuling program, the pressure to be exerted on the molten metal is first set at 35.2 Kg/cm$^2$ (500 pounds/inch$^2$) for pressurization for 0.2 seconds, is subsequently increased to 0.9 tons/6.45 cm$^2$ (2,000 pounds/inch$^2$) and further increased to 3 tons/6.45 cm$^2$.

On the other hand, Japanese Patent Second (examined) Publication (Tokko) Showa 53-12446 discloses a method for producing a fiber reinforced metal composition utilizing a fabricated fiber assembly formed into a desired configuration and consolidated with a metal matrix. During the process of consolidation, the pressure to be exerted on the molten metal is at first set at relatively low pressure and increased moderately, and thereafter increased rapidly to the maximum pressure. The pressure is maintained at the maximum pressure for a given period of time.

In the former case, a plurality plies of fiber sheets are piled or arranged for forming a desired configuration. A difficulty is encountered when a complex configuration of metal composition product, such as a piston is to be formed. Furthermore, discontinuities of fibers between the sheets may cause differences in the strength. Furthermore, by rapidly increasing the pressure to be exerted on the molten metal after a substantially short period in which relatively low pressure is exerted, a blow hole tends to be formed in the product.

In the later case, the following drawbacks are encountered:

(1) when volume density of the fiber assembly is relatively low, the assembly tends to be compressed to reduce the size to change volume density of the fiber assembly; and (2) when the volume density of the fiber assembly is in excess of 0.6 g/cm$^3$, resistance against the molten metal entering into the clearance between the fibers becomes excessive causing an increase in the pressure in the molten metal that degrades the quality of the final product.

Therefore, as will be appreciated herefrom, the prior proposed methods limit the configurations of the fiber reinforced composition to be formed and the kinds of fiber and/or metal matrix to be used.

SUMMARY OF THE INVENTION

Therefore, it is an object of the present invention to provide a method of producing a fiber reinforced composition which avoids limitations in material of the fiber and/or metal matrix and in configuration to form.

In order to accomplish the aforementioned and other objects, a method of producing a fiber reinforced metal composition, according to the present invention, is characterized by a unique and successful pressure exerting program for consolidating a fiber assembly fabricated into a desired configuration and a molten metal matrix. The program comprises a first step in which relatively low pressure is exerted on the molten metal for consolidation of the fiber assembly and the molten metal and a second step in which pressure is instantly increased to a maximum pressure for solidification of the metal matrix.

In the preferred process, the pressure to be exerted on the molten metal matrix is maintained at the lower pressure until consolidation of the fiber assembly and the molten metal matrix is completed, which completion of consolidation can be detected by monitoring pressure of the molten metal matrix.

According to one aspect of the invention, a method of producing a fiber reinforced metal composition is provided, comprising the steps of:

preparing a pre-assembly of a reinforcement fiber;

setting the reinforcement fiber pre-assembly in a cavity of a casting mold;

filling a molten metal matrix in the cavity of the casting mold;

impregnating of the molten metal matrix into the reinforcement fiber pre-assembly by exerting a first limited pressure; and pressure casting at a second maximum pressure for solidification of the metal matrix.

The impregnation is performed for a period necessary for completing impregnation of the molten metal matrix into the reinforcement fiber pre-assembly. The period during which impregnation is performed, is substantially short in relation to the period in which pressure casting is performed.

The fiber may be selected among carbon fiber, glass fiber, metal fiber and ceramic fiber and the metal matrix may be selected among iron, copper, aluminium, magnesium and alloys thereof.

The method may further comprise steps of:

pre-heating the reinforcement fiber pre-assembly;

pre-heating the cavity of the casting mold; and adjusting the temperature of the molten metal matrix.

On the other hand, the reinforcement fiber pre-assembly may be prepared by aggregating material fiber, shaping the fiber aggregate into a desired configuration and baking the shaped aggregate. Preferably, impregnation of the molten metal matrix is performed by exerting a pressure in a range of 30 kg/cm$^2$ to 100 kg/cm$^2$.

According to another aspect of the invention, a method of pressure casting a fiber reinforced metal composition comprises the steps of:

preparing a pre-assembly of a reinforcement fiber formed into a desired configuration;

pre-heating the reinforcement fiber pre-assembly at a first temperature;

pre-heating a cavity of a casting mold at a second temperature;

setting the reinforcement fiber pre-assembly in the cavity of the casting mold;

filling a molten metal matrix in the cavity of the casting mold;

impregnating of the molten metal matrix into the reinforcement fiber pre-assembly by exerting a first limited pressure which pressure is selected at a pressure close to an impregnation pressure; and pressure casting at a second maximum pressure for solidification of the metal matrix.

According to a further aspect of the invention, an apparatus for pressure casting a fiber reinforced metal composition comprises a casting mold defining a desired configuration of a casting cavity, in which a the reinforcement fiber pre-assembly fabricated into a desired configuration is set and a molten metal matrix is filled, a pressure means for exerting a pressure on the molten metal for performing pressure casting, the pressure means varying pressure exerted on the molten metal, a pressure sensor means for monitoring molten metal matrix pressure to produce a pressure indicative signal, and means for controlling the pressure means for adjusting the pressure to be exerted on the molten metal matrix, the controlling means initially controlling the pressure means to exert a first limited pressure to the molten metal matrix and responsive to the pressure indicative signal representing the molten metal matrix pressure higher than a predetermined pressure to control the pressure means to exert a maximum pressure.

Preferably, the pressure means comprises a hydraulic cylinder having a punch for transmitting a hydraulic pressure in the hydraulic cylinder to the molten metal, and a hydraulic circuit including a pressure control valve arrangement which adjusts the hydraulic pressure to be introduced between the limited pressure and a maximum pressure.

The controlling means maintains the pressure means to exert the limited pressure to the molten metal matrix in an initial period which is substantially short in relation to a period in which the pressure casting is performed by exerting the maximum pressure.

BRIEF DESCRIPTION OF THE DRAWINGS

The present invention will be understood more fully from the following detailed description and from the accompanying drawings of the preferred embodiment of the invention, which, however, should not be taken to limit the invention to the specific embodiment, but are for explanation and understanding only.

In the drawings.

DESCRIPTION OF THE PREFERRED EMBODIMENT

Figure 1:
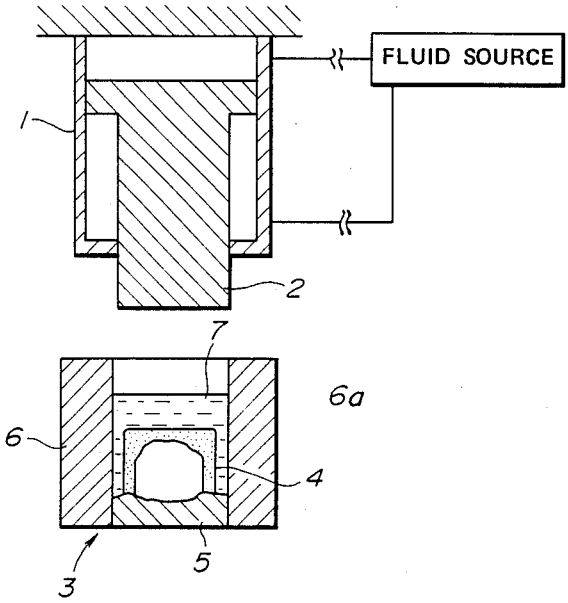
FIG. 1 is a fragmentary and explanatory illustration of an apparatus for implementing the preferred process of production of a fiber reinforced metal composition, according to the invention.

Referring now to the drawings, the details of the preferred embodiment of a fiber reinforced metal composition producing process and apparatus to be utilized for implementing the preferred process will be discussed.

FIG. 1 shows an apparatus which can be used in implementation of the preferred process of production of a fiber reinforced metal composition, according to the present invention. The apparatus includes a pressure cylinder 1 having a pressurizing punch 2. As will be seen from FIG. 1, the pressure cylinder 1 comprises a hydraulic cylinder and is thus connected to a pressurized working fluid source 8. The pressurized working fluid source 8 may include a pressure control mechanism for controlling fluid pressure to be supplied to the hydraulic cylinder 1.

The pressurizing punch 2 opposes a casting mold 3 which includes a mold body 6 defining a casting cavity 6*a*. A fiber assembly 4 which is fabricated into a desired configuration, is placed within the casting cavity 6*a* and supported by a core 5. Molten metal matrix 7 is filled in the casting cavity 6*a*.

In the preferred process, the material for forming the fiber assembly 4 may be selected among carbon fiber, glass fiber, metallic fiber, ceramic fiber and so forth. Among the various possible materials, ceramic fiber is preferred. The fiber assembly 4 is fabricated through a vacuum forming process and so forth. The process of fabricating the fiber assembly as proposed in Japanese Patent Second Publication (Tokko) Showa 54-36138 may not be preferred because it is troublesome to pile a plurality of fiber sheets and discontinuities of the constitutent fiber will cause lowering of strength.

The fiber assembly thus fabricated is preliminarily heated at a temperature in a range of 300° C. to 650° C. before putting in the casting mold 3. On the other hand, the molten metal matrix 7 is preliminarily adjusted to a temperature in a range of 700° C. to 800° C. Immediately after placing the fiber assembly 4 within the casting cavity 6*a*, the molten metal matrix 7 is filled in the casting cavity 6*a*. Metal to be used as the metal matrix is selected among iron, copper, aluminium, magnesium or alloys thereof. Of these, aluminium alloy and magnesium alloy are preferred.

It should be noted that the pre-heating temperature of the fiber assembly and the temperature of the molten metal matrix should be variable depending upon the materials used.

Figure 2:
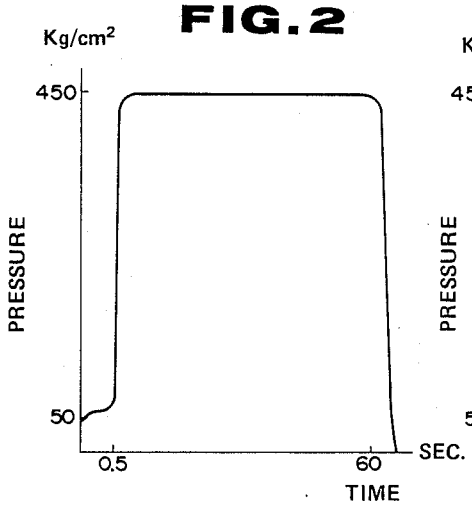
FIG. 2 is a timing chart showing variation of pressure to be exerted on molten metal matrix in relation to process time during fiber reinforced metal composition producing process according to the preferred method of the present invention.

As soon as filling of the molten metal matrix in the casting cavity is completed, pressure casting is initiated by supplying pressurized working fluid to the hydraulic cylinder 1 from the fluid source 8. During the pressure casting process, the pressure to be exerted on the molten metal matrix through the pressuring punch varies as illustrated in FIG. 2. As will be seen from FIG. 2, the pressure is maintained at a relatively low level at the initial stage of pressure casting. The preferred pressure at the initial stage is in a range of 30 kg/cm$^2$ to 100 kg/cm$^2$. By exerting relatively low pressure on the molten metal matrix, impregnation of metal matrix into fibers in the fiber assembly 4 can be achieved. Since the pressure during the impregnation process is held relatively low, compression of the fiber assembly or deformation of the fiber assembly which might otherwise result from excessive pressure, can be successfully avoided.

The pressure and a period to maintain the low pressure is selected depending upon the kind of inorganic fiber to be used, ratio (volume percent) of the fiber assembly, configuration of the fiber assembly, configuration of the cast product, and the kind of the molten metal material. The period for exerting the low pressure should be too long so as not to prevent deformation or formation of blow holes in the fiber assembly. As shown in FIG. 2, the preferred period for exerting low pressure may be about 0.5 sec. If the period is too short, impregnation of the molten metal to the fiber assembly will be incomplete.

Subsequent to the exerting of the low pressure, the pressure to be exerted on the molten metal matrix 7 is rapidly or instantly increased to the maximum pressure. Preferably, the maximum pressure is set in a range of 450 kg/cm$^2$ to 750 kg/cm$^2$. The period for exerting the maximum pressure is preferably about 1 minute. By exerting the maximum pressure to the molten metal which is solidifying, creation of blow holes can be successfully prevented. Furthermore, by exerting substantially high pressure to the solidifying molten metal, uniformity of construction of the final composition can be obtained.

Instant increase of the pressure exerted on the molten metal is advantageous in comparison with that proposed in Japanese Patent Second Publication (Tokko) Showa 54-36183 and Japanese Patent Second Publication (Tokko) Showa 53-12446, in which a process is proposed to gradually increase the pressure to be exerted on the molten metal. As set forth in the latter process, blow hole tend to form because of the relatively long transition in increasing of the pressure. The slow transition of pressure variation also affects uniformity of construction of the final product composition.

In the practical control of the pressure to be exerted on the molten metal and the periods to exert low and high pressure, the pressurized fluid supply from the pressurized fluid source 8 to the hydraulic cylinder 1 is performed.

It should be appreciated that the pressure of the molten metal may be absorbed by impregnation of the molten metal into the fiber assembly. This implies that as long as impregnation is incomplete, the molten metal pressure may be held at a impregnating pressure $P_0$. When the impregnation is completed and the fiber assembly is saturated, the pressure of the molten metal is increased toward the pressure of the pressurized fluid supplied to the hydraulic cylinder. Therefore, by monitoring pressure of the molten metal and detecting the pressure becoming higher than the impregnating pressure, completion of impregnation can be detected. On the other hand, as long as the volume ratio and density of fiber in the fiber assemblies can be held uniform, the necessary period of impregnation can be approximated through the several cycles of pressure casting processes. Therefore, after an approximate impregnation period is determined, the pressure in the pressure casting process can be controlled simply relying on the process time. This would be conveniently introduced because it does not require a pressure sensor for monitoring the molten metal pressure.

Figure 4:
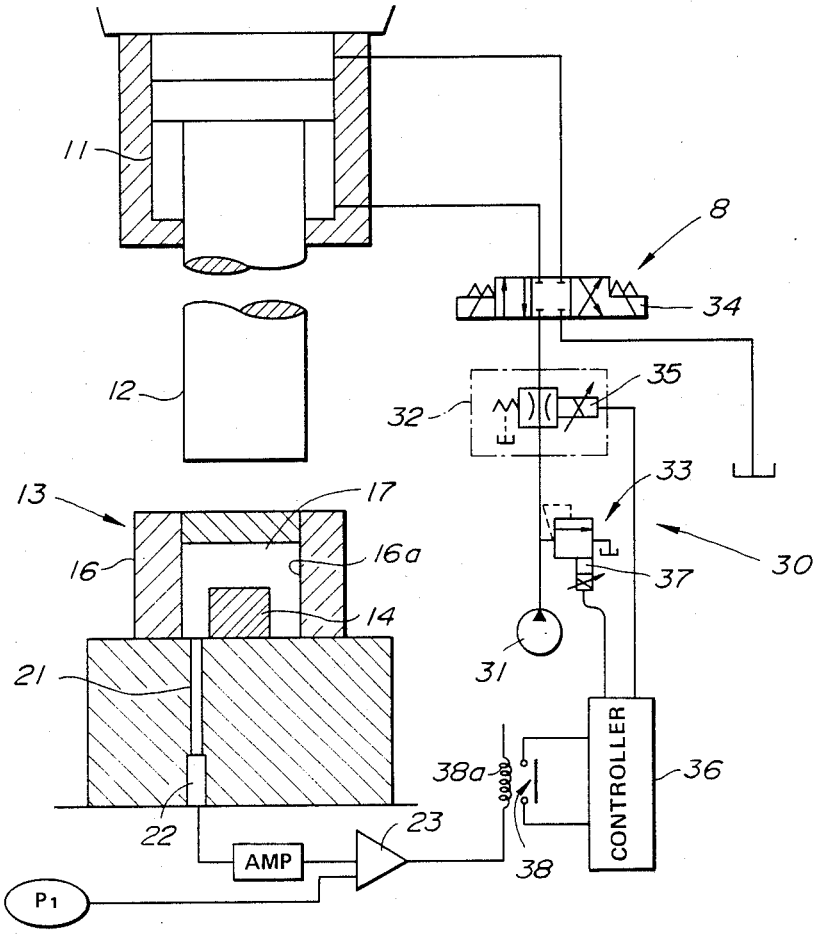
FIG. 4 is a fragmentary illustration of another embodiment of an apparatus for implementing the preferred process of production of a fiber reinforced metal composition, according to the invention.
Figure 5A:
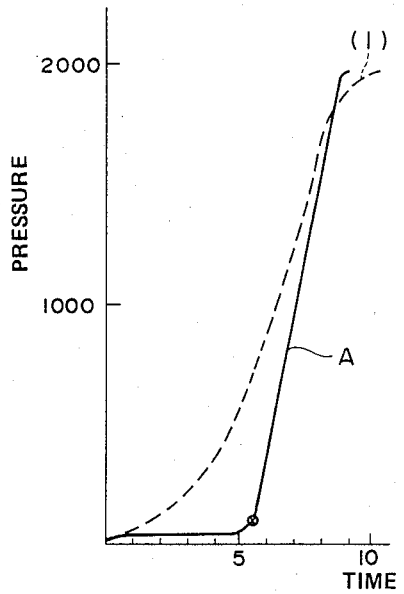
FIGS. 5*a*, 5*b*, 5*c* and 5*d* are charts showing pressure to be exerted on the molten metal in relation to process time as process in examples and comparative examples.
Figure 5B:
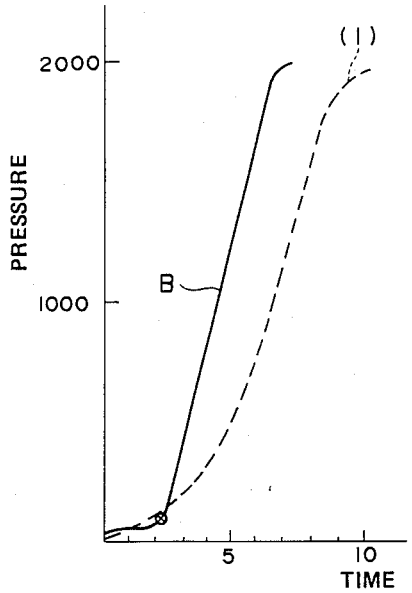
Figure 5C:
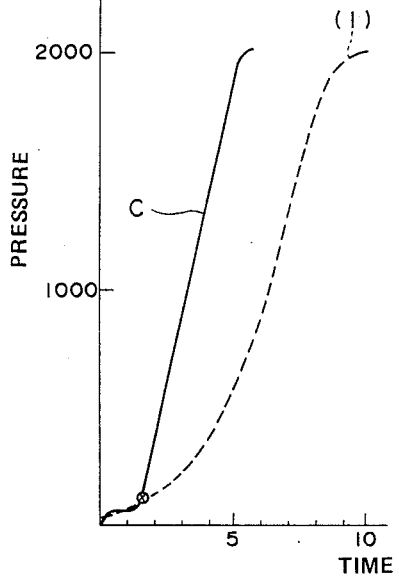
Figure 5D:
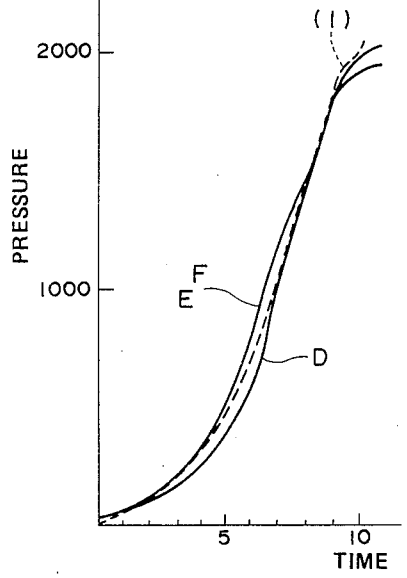

FIG. 4 shows another embodiment of the apparatus for implementing the preferred method of producing the fiber reinforced metal composition. In this embodiment, the pressurized fluid supply is controlled on the basis of the pressure of the molten metal.

Similarly to the former embodiment, the apparatus includes a hydraulic cylinder 11 having a pressurizing punch 12. The pressure cylinder 11 is connected to a pressurized working fluid source 8. The pressurized working fluid source 18 includes a pressure control unit 30 for controlling fluid pressure to be supplied to the hydraulic cylinder 11, which will be discussed later.

The pressurizing punch 12 opposes a casting mold 13 which includes a mold body 16 defining a casting cavity **16*a*. A fiber assembly 14, which is fabricated into a desired configuration, is placed within the casting cavity 16*a* and supported by a core 15. The core 15 is formed with an axially extending opening 20. A pressure sensing bar member 21 is sealingly disposed in the opening 20. The top end of the pressure sensing bar member 21 is exposed to the casting cavity 16*a* and the lower end of the bar member is associated with a pressure sensor 22. Therefore, the bar member 21 transmits the pressure of the molten metal 17 in the casting cavity 16*a* to the pressure sensor 22. The pressure sensor 22 is responsive to the input pressure from the bar member 21** and representative of the molten metal pressure, to produce a molten metal pressure indicative signal.

The molten metal pressure indicative signal is fed to an operational amplifier 23. To the operational amplifier 23 is also inputted a reference signal which is representative of a pressure (P1) which is slightly higher than the possible impregnating pressure (P0) for impregnating the molten metal into the internal structure of the fiber assembly 14. In the illustrated embodiment, the pressure P1 is set at a value of P0+1 (kg/cm$^2$). The operational amplifier 23 is designed to detect the molten metal pressure indicative signal value greater than the reference signal value to output a HIGH level signal.

The pressure control unit 30 includes a fluid pump 31, an electromagnetic proportioning valve 32 associated with a pressure relief valve 33 and a fluid supply control valve 34. The proportioning valve 32 has an electromagnetic actuator 35 which is connected to a controller 36. On the other hand, the pressure relief valve 33 has an electromagnetic actuator 37 which is also connected to the controller 36. The controller 36 has a relay switch 38 including a relay coil **38*a* connected to the operational amplifier 23. The relay coil 38*a* is energized in response to the HIGH level signal from the operational amplifier 23 to operate the actuator 35 to drive the proportioning valve 32 to increase fluid flow rate. On the other hand, the controller 36 operates the actuator 37 to shut the pressure relief valve 33 in response to the HIGH level signal from the operational amplifier 23. At the same time, the controller 36 operates the actuator 35 to fully open the proportioning valve 32**.

Therefore, as long as the molten metal pressure in the casting cavity is lower than the reference pressure P1 as represented by the reference signal, the pressure of the pressurized fluid is limited at a set pressure of the pressure relief valve 33. When the molten metal pressure becomes higher than or equal to the reference pressure, the maximum and non-limited pressure is exerted on the molten metal through the pressurizing punch.

In order to demonstrate and confirm the effect of the preferred method of production of the fiber reinforced metal composition, several experiments were performed. The following are discussions about the experiments performed with respect to the method according to the invention and comparative experiments according to the conventional method in order to compare the result with that obtained from the method of the invention.

EXAMPLE 1

In the first experiment, a piston of an internal combustion engine is produced through the process proposed in the present invention. As a material of fiber, an alumina system ceramic fiber (Tradename "Sufyl RF" available from ICI Company) was used. On the other hand, as material for metal matrix, Mg alloy (AS 21) was used.

The fibers were aggregated and baked to fabricate a fiber assembly in a configuration of the piston so that the volume percent thereof became 9% by volume. The fiber assembly was placed in a casting mold of FIG. 1. Before setting the fiber assembly, the casting mold was pre-heated at a temperature of 300° C. On the other hand, the fiber assembly was also pre-heated at a temperature of 650° C. before being set in the casting mold. The temperature of the molten Mg alloy matrix was adjusted at 720° C. before being filled in the casting cavity of the casting mold. Immediately after filling the molten Mg alloy matrix in the casting cavity, pressure in a magnitude of 50 kg/cm$^2$ was exerted on the Mg alloy matrix for 0.5 seconds. Thereafter, the pressure was rapidly increased to 450 kg/cm$^2$ according to the pressure variation characteristics as illustrated in FIG. 2. The pressure was held at 450 kg/cm$^2$ for about 1 minute. Through the process set forth above, a fiber reinforced Mg alloy piston was casted.

Additional experiments were performed by varying the initially exerted pressure in a range of 30 kg/cm$^2$ to 100 kg/cm$^2$ and the low pressure exerting period in a range of 0.3 seconds to 0.8 seconds.

The resulting pistons were subject to inspection. As a result, it was found that no deformation or compression of the fiber assemblies could be observed. Furthermore, no crack or blow hole was found in the final products. In addition, the strength of the products was uniform.

EXAMPLE 2

Similarly to the former example 1, alumina system ceramic fiber was used as material for fiber assembly. The fiber assembly was formed by substantially the same process as that discussed with respect to the example 1. However, the volume percent of the fiber assembly was adjusted to be 8% by volume. As a metal matrix, Al alloy (AC 8A) was used.

During preparation of pressure casting, the fiber assembly was pre-heated at a temperature of 450° C. before setting in the casting mold. Then, molten Al alloy matrix pre-heated at a temperature of 800° C. was filled in the casting cavity. Subsequently, an initial pressure of 50 kg/cm$^2$ was exerted on the molten Al alloy matrix for a period of 0.5 seconds. After 0.5 seconds expired, the pressure exerted on the molten Al alloy was increased to 700 kg/cm$^2$ according to the pressure variation characteristics as shown in FIG. 2. The pressure of 700 kg/cm$^2$ was maintained for about 1 minute. By this, a ceramic fiber reinforced Al alloy piston was formed.

The fiber reinforced ceramic fiber reinforced piston displayed equivalent properties to those obtained through the aforementioned example 1.

EXAMPLE 3

In this experiment, silicon carbide whiskers and an alumina system ceramic fiber were used as composite material for the fiber assembly. The fiber assembly was fabricated by forming and baking the composite material into the desired configuration of the piston. The volume percent of the fiber assembly prepared was 6% by volume. This fiber assembly was pre-heated at 650° C. before setting in the casting mold. The Mg alloy matrix was pre-heated at a temperature of 720° C.

The initial pressure to be exerted on the molten Mg alloy matrix was selected at 40 kg/cm$^2$. The pressure was maintained at 40 kg/cm$^2$ for 0.7 seconds. Subsequently, the pressure was rapidly increased to 950 kg/cm$^2$ according to the pressure variation characteristics of FIG. 2 and maintained for about 1 minutes.

The fiber reinforced Mg alloy piston formed through this experiment had equivalent properties to those obtained from the aforementioned example 1.

COMPARATIVE EXAMPLE 1

Figure 3:
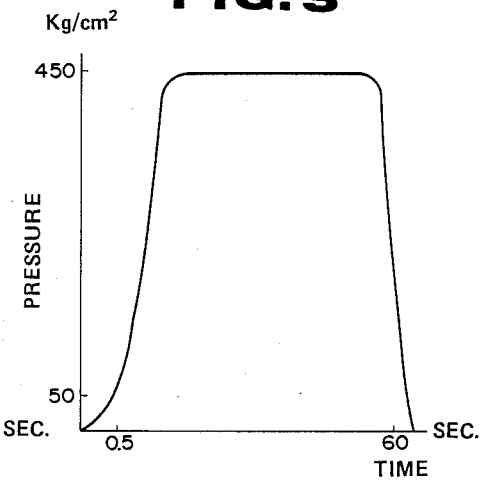
FIG. 3 is a similar timing chart to FIG. 2 showing variation of pressure to be exerted on molten metal matrix in relation to process time during fiber reinforced metal composition producing process in the conventional method.

This experiment was performed under essentially the same condition as that of the example 1. However, when pressure was increased from the low pressure to maximum pressure, the pressure was varied according to the characteristics shown in FIG. 3 so that the pressure increased at a relatively small ratio in comparison with the inventive method of example 1.

After pressure casting was completed, blow holes could be observed in the cross-section of the resultant fiber reinforced Mg alloy piston, though no deformation or compression of the fiber assembly could be observed.

EXAMPLE 4

As a material for fiber, crystallized glass fiber having fiber diameter in a range of 5 $\mu$m to 10 $\mu$m, fiber length of 200 $\mu$m to 300 $\mu$m, and density of 2.57 g/cm$^3$ was used. With the crystallized glass fiber, a cylindrical or disc-shaped fiber assembly of 70 mm in diameter, 10 mm in thickness, 0.3 g/cm$^3$ in volume density and 11.6% in Vf value was prepared. The fiber assembly was pre-heated in $N_2$ gas atmosphere to a temperature of 500° C. The pre-heated fiber assembly was set in a casting cavity which was formed in a configuration conforming to the piston and having an inner diameter of 80 mm. For implementing the pressure casting process, the apparatus of FIG. 4 was used.

The casting mold was pre-heated at a temperature of 450° C. As a material of the metal matrix, an alloy identified by JIS AC 8B was used. Before being filled in the casting cavity, the molten alloy was pre-heated at a temperature of 780° C. After filling the molten alloy, the pressure was exerted on the alloy via a pressurizing punch. Velocity of punch was varied as shown in the following table 1.

TABLE 1

| Condition | A | B | C | D | E | F |
|---|---|---|---|---|---|---|
| Velocity (mm/sec) | 1.5 | 5.0 | 7.5 | 10 | 20 | 30 |
| Po (kg/cm$^2$) | 23 | 45 | 55 | — | — | — |

In the experiments performed by varying the velocities of the pressurizing punch, the pressure of the molten metal as monitored by the pressure sensor of FIG. 4 via pressure transferring bar member is illustrated in FIGS. 5*a*, 5*b*, 5*c* and 5*d*. As will be seen from FIGS. 5*a*, 5*b* and 5*c*, in examples A, B and C, the impregnation pressure $P_0$ could be clearly observed. Utilizing the impregnation pressure $P_0$ from the conditions A, B and C, the reference signal values were set at pressures $P_1$ ($P_0+1$). Based on the set reference pressures, pressure control in pressure casting was performed.

For rapidly increasing the pressure to be exerted on the molten alloy matrix, the punch speed after the molten alloy pressure reached the reference pressures represented by the reference signals, was set at 80 mm/sec. By this, the pressure was increased to 2000 kg/cm$^2$ within 4 seconds. Then, the cast block was solidified in squeeze in per se known manner in the prior art.

Through the process set forth above, three samples respectively produced at different pressurization condition were obtained. These three samples had the same fiber assembly configuration, volume density, molten matrix composition, temperature and cast condition. In these three samples, no compression in the fiber assembly could observed. Furthermore, no deformation of the fiber assembly and no blow hole was observed.

COMPARATIVE EXAMPLE 2

In this experiment, fiber material and the matrix material was selected to be identical to that of the foregoing example 4. The initial punch speeds were set respectively at 10 mm/sec, 20 mm/sec and 30 mm/sec, as shown by D, E and F of table 1. Variation of the pressure in the process is illustrated in FIG. **5*d***. During pressure casting under the condition D, the pressure increase speed temporarily become lowered to around 70 kg/cm$^2$ in pressure but was soon recovered. For the conditions E and F, no impregnation pressure could be observed.

In the three sample blocks obtained through the pressure casting under the condition set forth above, compression of thickness of the fiber assembly was observed. Under the condition D, the thickness ratio of the fiber assembly in the produced block versus the original thickness was 92%. Similarly, under the condition E, the thickness ratio of the fiber assembly in the produced block versus the original thickness was 83%, and under the condition F, the thickness ratio of the fiber assembly in the produced block versus the original thickness was 77%.

Additionally, with taking the blocks processed in the condition A and condition D, impregnation was observed. For observing impregnating condition in each sample, pressure casting was stopped 4 seconds after starting pressurization. After a 4 second impregnation, uniform distribution of the matrix is observed within the fiber assembly which does not deformed or compressed, in case of the condition A. On the other hand, though the matrix was impregnated within the fiber assembly, deformation or compression was observed in case of condition D. From this observation, it was found that deformation was caused during the impregnation stage of pressure casting in case of condition D.

In addition, even when the impregnation period is expanded to 6 seconds in case of condition A, no deformation of the fiber assembly was observed.

EXAMPLE 5

Utilizing the same material as in example 4 and varying the Vf value to 5% (volume density 0.13 g/cm$^3$) and 27% (volume density 0.7/cm$^3$). For the samples having Vf value 5%, pressures of 12 kg/cm$^2$, 23 kg/cm$^2$ and 45 kg/cm$^2$ (conditions G, H and I) were selectively exerted at the initial stage of pressure casting. Similarly, for the samples having Vf value 27%, pressures of 49 kg/cm$^2$ and 67 kg/cm$^2$ (conditions K and L) were selectively exerted at the initial stage of pressure casting. Pressure casting was performed under casting condition which is essentially the same as that of the example 4. Other casting conditions are shown in the appended table 2.

After completing the casting process, the cast blocks are checked. In the checking, no blow hole could observed in any casted blocks. Other results of observation are shown in the table 2.

COMPARATIVE EXAMPLE 3

For the sample having Vf value of 5%, pressure was exerted by operating the punch at a velocity of 20 mm/sec (condition J). Similarly, for the sample having Vf value of 27%, pressure was exerted by operating the punch at velocity of 8 mm/sec (condition M) and 20 mm/sec (condition N). In these experiments, impregnation at low pressure was not performed. Other casting conditions were identical to that of the example 5.

After completing the pressure casting process, the resultant sample blocks are checked. No blow hole was found in any sample. However, deformation of the fiber assembly was observed in every sample block.

EXAMPLE 6

As a material of the fiber assembly, alumina short fibers having fiber diameter of 3 $\mu$m and fiber length of 220 $\mu$m were used. Utilizing this material fiber, fiber assemblies having Vf values respectively of 6% (volume density 0.2 g/cm$^3$), 12% (volume density 0.4 g/cm$^3$) and 25% (volume density 0.83 g/cm$^3$) were prepared. The configuration of the fiber assemblies was the same as that used in the example 4.

The fiber assemblies were pre-heated at a temperature of 450° C. The pre-heated fiber assemblies were respectively set in the casting cavities of the casting molds which were respectively pre-heated at a temperature of 500° C. Mg alloy (JIS A Z92) matrix was filled for respective casting cavities. Then pressure casting was performed with respect to respective samples. Pressurization conditions for respective samples are set so that 16 kg/cm$^2$ (condition O) and 30 kg/cm$^2$ (condition P) were selectively exerted for the sample having the fiber assembly of Vf value being 0.6%. On the other hand, pressures of 27.5 kg/cm$^2$ (condition Q), 50 kg/cm$^2$ (condition R) were selectively exerted on the samples having fiber assemblies having Vf value of 27.5%, and pressures of 73.5 kg/cm$^2$ (condition S), 81 kg/cm$^2$ (condition T) were selectively exerted on the samples having fiber assemblies having Vf value of 25%.

In observation of the casted sample blocks, no deformation of the fiber assembly was observed in the samples cast under the conditions O, P, Q, R and S. On the other hand, in case of the condition T, a substantially small magnitude of deformation was observed in the cased sample block. Deformation as observed causes reduction of the thickness of the sample, in which thickness ratio versus the original thickness was 98%. Since the reduction of the thickness due to deformation was substantially small, the cast block obtained through the pressure casting process under the condition T are acceptable for practical use.

In addition, no blow hole was observed in any of the cast sample blocks.

EXAMPLE 7

As a material fiber, silicon carbide whiskers having fiber diameter of 0.3 μm and fiber length of 100 μm was used. Utilizing the silicon carbide whiskers set forth above, a fiber assembly having Vf value of 30% and volume density of 0.96 g/cm$^3$ was prepared. The fiber assembly was pre-heated in $N_2$ atmosphere to a temperature of 600° C. The pre-heated fiber assembly was set in the casting cavity of the apparatus of FIG. 4, which casting cavity was pre-heated at a temperature of 600° C. To the casting cavity, molten pure copper at a temperature of 1250° C. was filled. Pressure was exerted on a molten copper according to the pressurization pattern the same as that discussed with respect to the example 4. The initial pressures were set at 85 kg/cm$^2$ (condition U) and 93 kg/cm$^2$ (condition V).

Observations of the casted sample blocks are shown in the table 2.

COMPARATIVE EXAMPLE 4

For the same sample as in the example 7, pressure casting was performed by driving the punch at a velocity of 10 mm/sec (condition W). After the casting operation, the fiber assembly was deformed to reduce the thickness to 88% of the original thickness.

EXAMPLE 8

As a material for forming the fiber assembly, γalumina long fiber containing 85% of $Al_2O_3$ and 15% of $SiO_2$ was used. Utilizing this material fiber, an alumina long fiber cloth assembly having fiber diameter of 9 μm, Vf value of 60% and volume density of 1.92 g/cm$^3$ was prepared. The fiber assembly was pre-heated at a temperature of 1000° C. and set in the casting cavity of the apparatus of FIG. 4, which was pre-heated at a temperature of 600° C. To the casting cavity, a molten metal matrix of Ti-6Al-4V alloy, which was adjusted to a temperature of 1800° C. was filled. Pressure casting was performed by varying the pressure to be exerted on the molten metal matrix according to a pressurization pattern the same as that of the example 4. However, the initial pressures were set at 68 kg/cm$^2$ (condition X), 78 kg/cm$^2$ (condition Y) and 91 kg/cm$^2$ (condition Z).

Observation of the cast samples are shown in table 2. In case of the condition Z, slight deformation was observed in the fiber assembly. However, the magnitude of deformation as observed was not substantial and is maintained in acceptable level in practical use.

As will be appreciated herefrom, according to the present invention, fiber reinforced metal composition blocks in any desired configuration can be cast without causing deformation of the fiber assembly which forms a core of the casted block, without forming blow holes, and with substantially uniform strength distribution.

While the present invention has been disclosed in terms of the preferred embodiment in order to facilitate better understanding of the invention, it should be appreciated that the invention can be embodied in various ways without departing from the principle of the invention. Therefore, the invention should be understood to include all possible embodiments and modifications to the illustrated embodiments which can be embodied without departing from the principle of the invention set out in the appended claims.

TABLE 2

| Condition | Fiber | Matrix | Vf (%) | $P_0$ (kg/cm$^2$) | Vel. (mm/sec) | t/to (%) | Blow Hole | Remarks |
|---|---|---|---|---|---|---|---|---|
| G | Crystallized | | 5 | 12 | 1.5 | 100 | Non | Example 5 |
| H | Glass Fiber | Aluminium | 5 | 23 | 5 | 100 | Non | Example 5 |
| I | Diameter | Alloy | 5 | 45 | 10 | 100 | Non | Example 5 |
| J | 5 μm-10 μm | | 5 | — | 20 | 70 | Non | Comparative 3 |
| K | Length | JIS AC 8B | 27 | 49 | 1.2 | 100 | Non | Example 5 |
| L | 200 μm-300 μm | | 27 | 67 | 5 | 100 | Non | Example 5 |
| M | Density | | 27 | — | 8 | 91 | Non | Comparative 3 |
| N | 2.57 g/cm$^2$ | | 27 | — | 20 | 56 | Non | Comparative 3 |
| O | Alumina Short | | 6 | 16 | 1.2 | 100 | Non | Example 6 |
| P | Fiber | Magnesium | 6 | 30 | 5 | 100 | Non | Example 6 |
| Q | | Alloy | 12 | 27.5 | 1.2 | 100 | Non | Example 6 |
| R | Diameter 3 μm | | 12 | 50 | 5 | 100 | Non | Example 6 |
| S | Length 200 μm | JIS A Z92 | 25 | 73.5 | 5 | 100 | Non | Example 6 |
| T | | | 25 | 81 | 7.5 | 98 | Non | Example 6 |
| U | SiC Whiskers | Pure | 30 | 85 | 5 | 100 | Non | Example 7 |
| V | Diameter 0.3 μm | Copper | 30 | 93 | 8.2 | 100 | Non | Example 7 |
| W | Length 100 μm | | 30 | — | 10 | 88 | Non | Comparative 4 |
| X | γ Alumina Fiber | | 60 | 68 | 1.2 | 100 | Non | Example 8 |
| Y | Cloth | Ti-6Aχ-4V | 60 | 78 | 5 | 100 | Non | Example 8 |
| Z | Diameter 9 μm | | 60 | 91 | 10 | 94 | Non | Example 8 |

What is claimed is:

1. A method of producing a fiber reinforced metal composition, comprising the steps of:
   - preparing a pre-assembly of a reinforcement fiber;
   - setting said reinforcement fiber pre-assembly in a cavity of a casting mold;
   - filling a molten metal matrix in said cavity of said casting mold;
   - impregnating said molten metal matrix into said reinforcement fiber pre-assembly by exerting a first substantially constant pressure;
   - rapidly increasing pressure to a second maximum pressure; and
   - pressure casting at the second maximum pressure for solidification of said metal matrix.

2. A method as set forth in claim 1, wherein said impregnation is performed for a period necessary for completing impregnation of molten metal matrix into said reinforcement fiber pre-assembly.

3. A method as set forth in claim 2, wherein said period, in which impregnation is performed, is substantially short in relation to a period in which said pressure casting is performed.

4. A method as set forth in claim 1, wherein said fiber is selected among carbon fiber, glass fiber, metal fiber and ceramic fiber.

5. A method as set forth in claim 1, wherein material of said metal matrix is selected among iron, copper, aluminium, magnesium and alloys thereof.

6. A method as set forth in claim 1, which further comprises steps of:

pre-heating said reinforcement fiber pre-assembly;

pre-heating said cavity of said casting mold; and adjusting temperature of said molten metal matrix.

7. A method as set forth in claim 1, wherein said reinforcement fiber pre-assembly is prepared by aggregating material fiber, shaping the fiber aggregate into a desired configuration and baking the shaped aggregate.

8. A method as set forth in claim 1, wherein said impregnation of said molten metal matrix is performed by exerting a pressure in a range of 30 kg/cm$^2$ to 100 kg/cm$^2$.

9. A method of pressure casting a fiber reinforced metal composition, comprising the steps of:

preparing a pre-assembly of a reinforcement fiber formed into a desired configuration;

pre-heating said reinforcement fiber pre-assembly at a first temperature;

pre-heating a cavity of a casting mold at a second temperature;

setting said reinforcement fiber pre-assembly in said cavity of said casting mold;

filling a molten metal matrix in said cavity of said casting mold;

impregnating said molten metal matrix into said reinforcement fiber pre-assembly by exerting a first substantially constant pressure which pressure is selected at pressure close to an impregnation pressure;

rapidly increasing pressure to a second maximum pressure; and pressure casting at the second maximum pressure for solidification of said metal matrix.

10. A method as set forth in claim 9, wherein said period, in which impregnation is performed, is substantially short in relation to a period in which said pressure casting is performed.

11. A method as set forth in claim 9, wherein said fiber is selected among carbon fiber, glass fiber, metal fiber and ceramic fiber.

12. A method as set forth in claim 11, wherein material of said metal matrix is selected among iron, copper, aluminium, magnesium and alloys thereof.

13. A method as set forth in claim 9, wherein said reinforcement fiber pre-assembly is prepared by aggregating material fiber, shaping the fiber aggregate into a desired configuration and baking the shaped aggregate.

14. A method as set forth in claim 9, wherein said impregnation of said molten metal matrix is performed by exerting a pressure in a range of 30 kg/cm$^2$ to 100 kg/cm$^2$.

15. A method as set forth in claim 9, which further comprises a step of monitoring pressure of said molten metal during said impregnation process, for detecting molten metal pressure increasing across an impregnating pressure to detect completion of impregnation process.

16. A method of producing a fiber reinforced metal composition, comprising the steps of:

preparing a pre-assembly of a reinforcement fiber;

setting the reinforcement fiber pre-assembly in a cavity of a casting mold;

filling a molten metal matrix in the cavity of the casting mold;

impregnating the molten metal matrix into the reinforcement fiber pre-assembly by exerting a first limited pressure;

monitoring pressure of the molten metal during the impregnation process to detect an increase in the molten metal pressure above an impregnating pressure to detect completion of the impregnation process;

rapidly increasing pressure to a second maximum pressure; and pressure casting at the second maximum pressure for solidification of said metal matrix.

17. An apparatus of pressure casting a fiber reinforced metal composition, comprising:

a casting mold defining a desired configuration of a casting cavity, in which a said reinforcement fiber pre-assembly fabricated into a desired configuration is set and a molten metal matrix is filled;

a pressure means for exerting a pressure on said molten metal for performing pressure casting, said pressure means varying pressure exerted on said molten metal;

a pressure sensor means for monitoring molten metal matrix pressure to produce a pressure indicative signal; and means for controlling said pressure means for adjusting the pressure to be exerted on said molten metal matrix, said controlling means initially controlling said pressure means to exert a first limited pressure to said molten metal matrix and responsive to said pressure indicative signal representing the molten metal matrix pressure higher than a predetermined pressure to rapidly increase said pressure means to exert a maximum pressure.

18. An apparatus as set forth in claim 17, wherein said pressure means comprises a hydraulic cylinder having a punch for transmitting a hydraulic pressure in said hydraulic cylinder to said molten metal, and a hydraulic circuit including a pressure control valve arrangement which adjusts the hydraulic pressure to be introduced between said limited pressure and a maximum pressure.

19. An apparatus as set forth in claim 18, further comprising means for aggregating material fiber, shaping the fiber aggregate into a desired configuration and baking the shaped aggregate.

20. An apparatus as set forth in claim 18, further comprising a signal sent from said controlling means to said pressure means, wherein said signal causes said pressure means to exert a constant limited pressure on said molten metal matrix in a range of 30 kg/cm$^2$ to 100 kg/cm$^2$.

* * * * *